United States Patent [19]

Sherman

[11] 4,187,867

[45] Feb. 12, 1980

[54] FLUID BEARING

[75] Inventor: Charles J. Sherman, Frenchtown, N.J.

[73] Assignee: Western Electric Company, Inc., New York, N.Y.

[21] Appl. No.: 947,925

[22] Filed: Oct. 2, 1978

Related U.S. Application Data

[62] Division of Ser. No. 786,512, Apr. 11, 1977, Pat. No. 4,138,047.

[51] Int. Cl.[2] ..... B65H 17/32; B65H 23/24

[52] U.S. Cl. ..... 134/64 P; 68/158; 68/207; 118/419

[58] Field of Search ..... 226/3, 7, 97, 109; 34/23, 24, 154, 156; 134/15, 64 R, 64 P, 122 R, 122 P; 214/1 BE; 354/321, 339; 302/2 R, 29, 31; 198/811; 271/195; 68/150, 158, 189, 198, 199, 207; 118/419, 427, 429

[56] References Cited

U.S. PATENT DOCUMENTS

| | | | |
|---|---|---|---|
| 3,057,079 | 10/1962 | Schmidt | 226/97 X |
| 3,097,971 | 7/1963 | Carlisle et al. | 226/97 X |
| 3,186,326 | 6/1965 | Schmidt | 226/97 X |
| 3,290,795 | 12/1966 | Jarreby | 226/97 X |
| 3,521,802 | 7/1970 | Bossons | 226/97 |
| 3,640,100 | 2/1972 | Marz | 68/150 |
| 3,643,477 | 2/1972 | Lorenz | 68/150 |

FOREIGN PATENT DOCUMENTS

| | | | |
|---|---|---|---|
| 220211 | 3/1910 | Fed. Rep. of Germany | 68/198 |

*Primary Examiner*—Philip R. Coe
*Attorney, Agent, or Firm*—Joel F. Spivak

[57] ABSTRACT

A fluid bearing for supporting, independently of each other, a plurality of webs. The bearing comprises a housing, for containing a fluid within its interior, having an outer surface for cooperating with a surface of each web of the plurality of webs. A guide flange is provided on the outer surface, defining with the outer surface a support channel. The guide flange maintains the plurality of webs within the boundaries of the defined support channel. A fluid outlet and a fluid inlet are provided for passing the fluid from the interior of the housing through the outer surface, within the channel, to form a fluid layer thereover having a fluid spike therein, for independently supporting each web.

6 Claims, 6 Drawing Figures

FLUID BEARING

This is a division, of application Ser. No. 786,512 filed Apr. 11, 1977, and now U.S. Pat. No. 4,138,047.

BACKGROUND OF THE INVENTION

1. Field of the Invention

This invention relates to a fluid bearing and more particularly, to a fluid bearing capable of supporting, independently of each other, a plurality of articles such as webs or strip materials.

2. Description of the Prior Art

In the past it has been common practice in chemically treating articles, such as strip or web material, to provide a plurality of tanks, each containing a different processing liquid. In each tank, liquid bearings have been provided which separate from one another each web of a pair of webs. Such liquid bearings are not capable of supporting an individual web or a plurality of webs without the use of guide rings. Where a single web of a first width is to be processed, custom-made bearings must be fabricated since a fluid bearing having a particular guide ring structure incapable of accommodating the first width, for example, cannot be employed. Therefore, a fluid bearing which can support and transport a single article of varying sizes or a plurality of articles, independently of each other, without the use of guide rings, is needed and desired.

SUMMARY OF THE INVENTION

This invention relates to a fluid bearing and more particularly, to a fluid bearing capable of supporting, independently of each other, a plurality of articles such as webs or strip materials.

The bearing comprises a housing, for containing a fluid within its interior, having an outer surface for cooperating with a surface of an article. A guide means is provided on the outer surface, defining with the outer surface a support channel, for maintaining the article within the boundaries of the defined support channel. A means is provided for passing the fluid from the interior through the outer surface, within the channel, to the exterior to form a fluid layer thereover having at least one fluid spike therein, the fluid layer supporting the article and the fluid spike restricting the supported article to an area over the channel.

BRIEF DESCRIPTION OF THE DRAWINGS

The present invention will be more readily understood by reference to the following drawing taken in conjunction with the detailed description, wherein.

DETAILED DESCRIPTION

Figure 1:
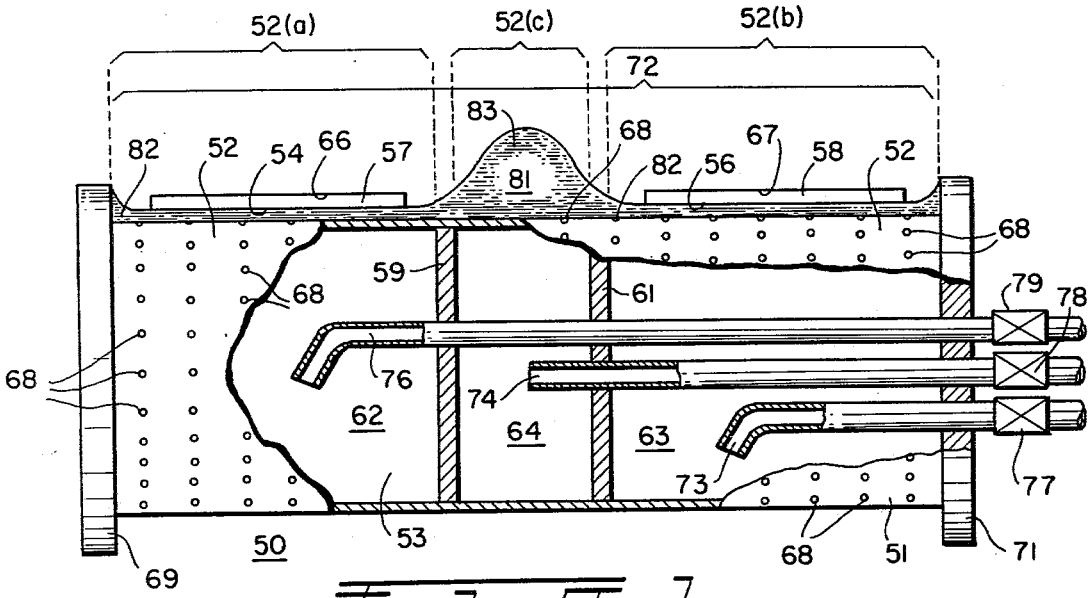
FIG. 1 is a partial cross-sectional view of one embodiment of a fluid bearing of the invention.

Referring to FIG. 1, there is shown a fluid bearing 50 having a housing 51. Illustratively, housing 51 is a cylinder having a curved outer surface 52 and a hollow interior 53. Outer surface 52 cooperates with a surface of a plurality of articles, illustratively with a surface 54, 56 of each web 57 and 58, respectively, of a pair of webs, which are destined to be supported by and transported over bearing 50. In other words, principal surfaces 54 and 56 are supported and pass over outer surface 52. Depending upon the desired application, housing 51 may be curvilinear, e.g., cylindrical, ellipsoidal or rectilinear, e.g., rectangular, square, rhomboidal, trapezoidal, etc. Interior 53 of housing 51 is partitioned by a first wall 59 and a second wall 61 to form a first article or web chamber 62 and a second article or web chamber 63. Adjacent to and separating chambers 62 and 63 is a third or guide chamber 64. Chambers 62, 63 and 64, as illustrated, are colinear, i.e., concentric, however, they may lie on the same straight line in a colinear relationship or they may lie in a non-colinear relationship with one another. Chamber 64, however, must be adjacent to and separate chambers 62 and 63 for each pair of webs 57 and 58 of the plurality of webs to be supported by and transported over bearing 50. The size of each chamber (62, 63 and 64) is dependent upon the size of each web 57 and 58 of the pair of webs to be supported by bearing 50. The cross-sectional areas of chambers 62, 63 and 64, adjacent to the outer surface 52, are defined by an area 52(*a*), 52(*b*) and 52(*c*), respectively, of outer surface 52. Web 57, of the pair of illustrated webs, is destined to cooperate with surface 52(*a*), that is, it is destined to be transported over, maintained within and supported over area 52(*a*) with both major surfaces 54 and 66 of web 57 lying across area 52(*a*) while, concurrently, web 58 of the pair of webs is destined to be transported over, maintained within and supported over area 52(*b*) of surface 52 with both major surfaces 56 and 67 thereof lying across area 52(*b*). Accordingly, areas 52(*a*) and 52(*b*) each have a dimension which is slightly greater than the width of the principal web surfaces (54, 66, 56, 67) with which it is coaxial.

Area 52(*c*) should be of a sufficient size to permit the formation thereover of a fluid force which separates from one another web 57 and web 58. Such a fluid force is to be described hereinafter.

Chambers 62, 63 and 64 each contain a fluid destined to be passed therefrom through a fluid outlet means, which illustratively comprises at least one aperture 68 within each chamber (62, 63, 64). Each aperture 68 passes through outer surface 52 within areas 52(*a*), 52(*b*) and 52(*c*) to communicate each chamber (62, 63, 64) with the exterior of housing 51 in a fluid flow relationship.

Illustratively, a plurality of circular apertures are shown which may be provided completely around the circumference of cylindrical housing 51 or only partly around. Aperture 68 may be in any geometrical form, e.g., circular, rectangular, ellipsoidal, etc., and the number positioning and patterning thereof and their design and size may be varied as appropriate to achieve the optimum use of the fluid employed and contained in the chambers (62, 63, 64) according to the weight and size of the articles to be supported by bearing 50, in accordance with the pressure of the fluid employed therewith.

Figure 2:
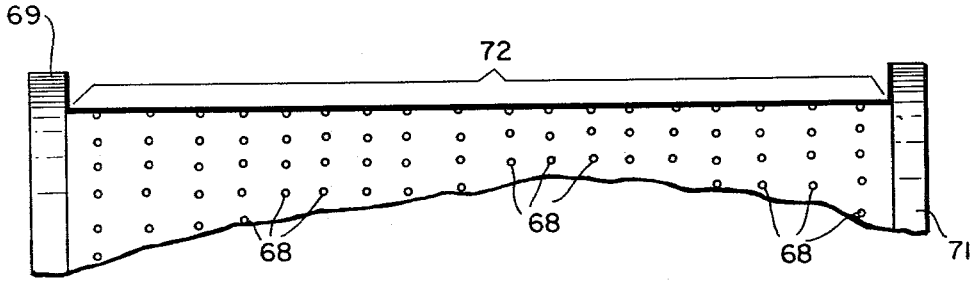
FIG. 2 is a partial cross-sectional view of the fluid bearing of FIG. 1.

Secured to housing 51 is a first flange member 69 spaced apart from a second flange member 71, both of which function as guide means. Flange members 69 and 71 are in the form of caps which seal each end of housing 51. While flange members 69 and 71 are shown as extending completely around housing 51, it is only necessary that these flange members should extend partway around housing 51. Flange members 69 and 71 together with outer surface 52 define a strip or web supporting channel 72, as shown in FIGS. 1 and 2, which is adapted to receive the pair of webs 57, 58 with their major surfaces (54, 66, 56, 67) lying across areas 52(*a*) and 52(*b*) of outer surface 52 and thus across web supporting channel 72. Flange members 69 and 71 maintain the pair of webs 57, 58 (or a plurality of webs where there are multiple web pairs and multiple sets of chambers [62, 63, 64] for each web pair) within the boundaries of the defined support channel 72.

It is to be noted that any guide means may be employed to maintain webs 57, 58 within support channel 72. For example, apertures may be provided which provide a high-pressure fluid curtain, relative to adjacent areas in outer surface 52, which define, with the outer surface 52 of housing 51, supporting channel 72 and which maintain webs 57, 58 therewithin.

It will be appreciated, of course, that in order for a web not to be forced completely out of channel 72, it is necessary for a slight amount of tension to be exerted on the web on opposite sides of bearing 50, this tension being just sufficient to retain the web in channel 72.

Passing through flange member 71 is a first fluid inlet tube 73 which introduces or supplies the fluid into chamber 63 at a predetermined fluid pressure from a reservoir (not shown) by means of a pump (not shown). A second fluid inlet tube 74 passes through flange 71 and partition wall 61 into chamber 64 for separately introducing the fluid therein from the reservoir. A third fluid inlet tube 76 passes through flange 71, partition walls 61 and 59 and into chamber 62 for separately introducing the fluid therein from the reservoir. Fluid inlets 73, 74 and 76 each have a conventional valving means 77, 78 and 79, respectively, for controlling the amount of fluid passed therethrough. Valving means 77, 78 and 79 permit the fluid to pass into chambers 62, 63 and 64 at equal or different fluid pressures and/or speeds.

In the operation of fluid bearing 50, webs 57 and 58 are positioned in or driven over web support channel 72 (FIGS. 1 and 2) in a conventional manner, such as by a motor-driven contacting roller or by a take-up unit positioned subsequent to bearing 50. Fluid is supplied from the reservoir (not shown) under a given pressure by means of the pump (not shown) into chambers 62, 63 and 64 by means of inlet means 76, 73 and 74, respectively. The fluid passes through chambers 62, 63 and 64 through outlet means 68 through outer surface 52 to the exterior of housing 51 to form a fluid layer 81 which independently supports webs 57 and 58 of the pair of webs. The fluid comprising fluid layer 81 is passed through outlet means (apertures) 68 in such a fashion as to form separate portions or valleys 82 of fluid layer 81 capable of lifting and supporting, independently of each other, webs 57 and 58 and to form a fluid spike (a fluid force) 83 therein capable of separating from one another webs 57 and 58. By a fluid spike is meant a distribution of fluid flow of greater dynamic pressure than the surrounding fluid.

Fluid spike 83 is established by passing the fluid through apertures 68 contained within area 52(*c*) of outer surface 52 (defining the adjacent cross-sectional area of chamber 64) at a relatively higher pressure than the fluid being passed through apertures 68 contained within the adjacent areas 52(*a*) and 52(*b*) of outer surface 52 of housing 51. Such a fluid spike 83 can be affected by (1) passing the fluid into chamber 64 at a higher pressure than the fluid being passed in chambers 62 and 63 as by controlling the valving means (77, 78, 79) where apertures 68 are of the same size, configuration and/or pattern or by (2) passing fluid through the chambers (62, 63, 64) at the same fluid pressure, but varying the sizes, shapes and/or pattern of apertures 68 within areas 52(*a*), 52(*b*) and 52(*c*) of outer surface 52. Affecting fluid spike 83 can also be accomplished by providing elbows or turns in inlet means 73 and 76 to create a resistance to free fluid flow, whereas inlet 74 is relatively linear. Such fluid pressure techniques are well known and need not be elaborated herein.

Figure 3:
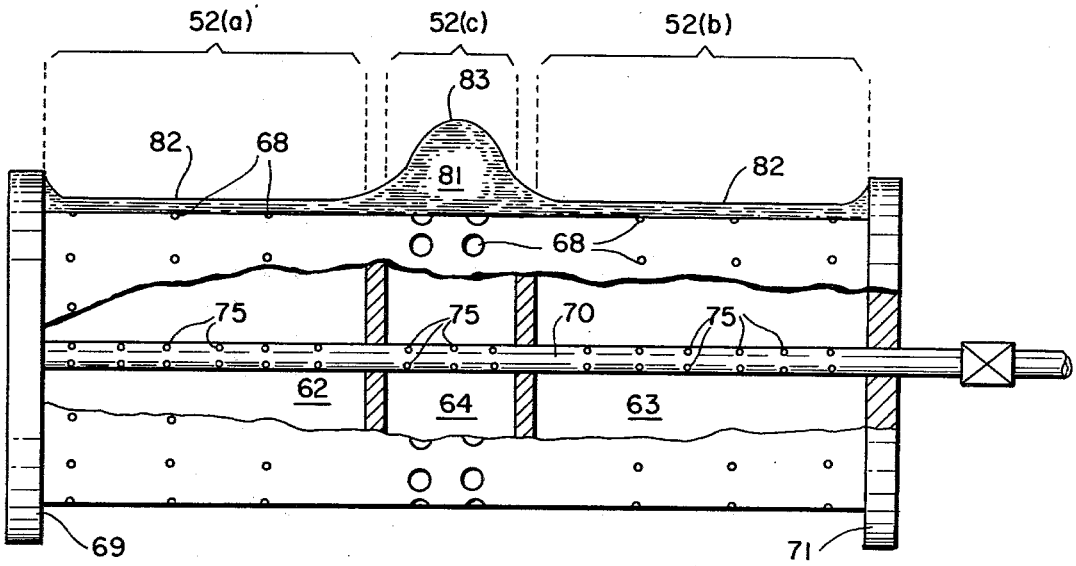
FIG. 3 is a partial cross-sectional view of the fluid bearing of FIG. 1 having an alternative fluid inlet means.

It is to be pointed out, however, that various combinations of inlet and outlet means may be employed to establish the dynamic pressure gradient relationship described above and the invention disclosed herein is not limited to a plurality of independent fluid inlet means, but may include a single common fluid inlet means. In this regard, reference is made to FIG. 3 which shows an embodiment of my invention in which a common fluid inlet means 70 is employed for supplying fluid to chambers 62, 63 and 64, from apertures 75 contained therein, to pass the fluid through apertures 68 to form fluid layer 81. Differential fluid pressures may be obtained by suitable design of the shape, size and pattern orientation of apertures 68 in a manner known in the art. For example, illustratively, apertures 68 within area 52(*c*) of surface 52 are larger than in adjoining areas to provide fluid spike 83, which is essentially within an area of fluid layer 81 corresponding to the adjacent cross-sectional area of chamber 64. Alternatively, differential fluid pressures may be obtained by suitable design of the size, shape and pattern orientation of apertures 75 of common inlet means 70.

Figure 4:
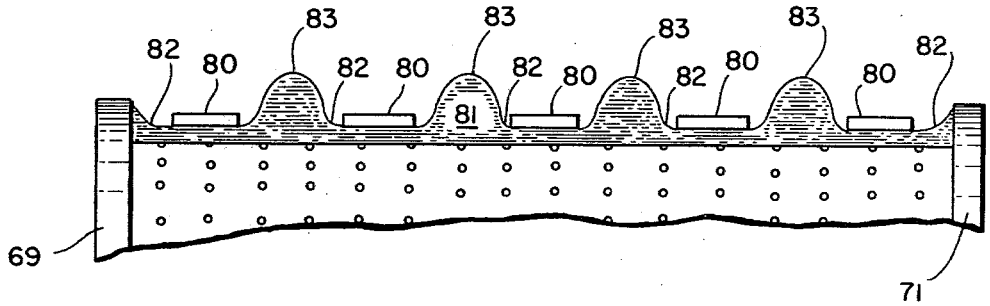
FIG. 4 is a partial perspective view of the bearing of FIG. 1 supporting a plurality of webs.

Referring to FIG. 4, where a plurality of webs 80 are supported by the fluid bearing of the invention (containing a pair of web chambers and a guide chamber for each pair of adjacent webs), fluid layer 81 is represented by a plurality of hills or fluid spikes 83 and valleys 82, the former separating from one another each web 80 and the valleys floating or supporting independently of one another each web 80.

Referring back to FIG. 1, it has surprisingly been found that when web 57 alone is passed over channel 72 of bearing 50, it is restricted or maintained within the exterior above area 52(*a*) by fluid layer 81. Web 57 is independently supported by fluid layer 81 despite the fact that adjacent portions of fluid layer 81, for example, above area 52(*b*), do not have restrictions with respect to the fluid flowing therefrom. This is surprising since fluid inlets 73, 74 and 76 are supplied from a common fluid reservoir (not shown), and, therefore, the pressure difference due to a greater resistance to fluid flow in web chamber 62, which supports web 57, relative to a lower resistance to fluid flow in web chamber 63, which does not support a web, should be communicated to the common fluid supply point resulting in an imbalance of fluid flow such that web 57 would not be expected to be independently supported.

Bearing 50 has been described in terms of three separate chambers for each pair of adjacent webs to be supported. The use of separate chambers (62, 63, 64 of FIG. 1) permits a pressure gradient to be established within the interior of housing 51 of bearing 50 (FIG. 1). The use of separate chambers permits such a pressure gradient to be easily established and controlled. However, it is to be pointed out that alternatively, an unpartitioned housing 51 can be employed whereby a fluid pressure gradient can be established above area 52(*c*) by means of designing apertures 68 in a fashion known to those skilled in the art, such as for example, by having larger apertures within area 52(*c*) than in adjacent areas.

Figure 5:
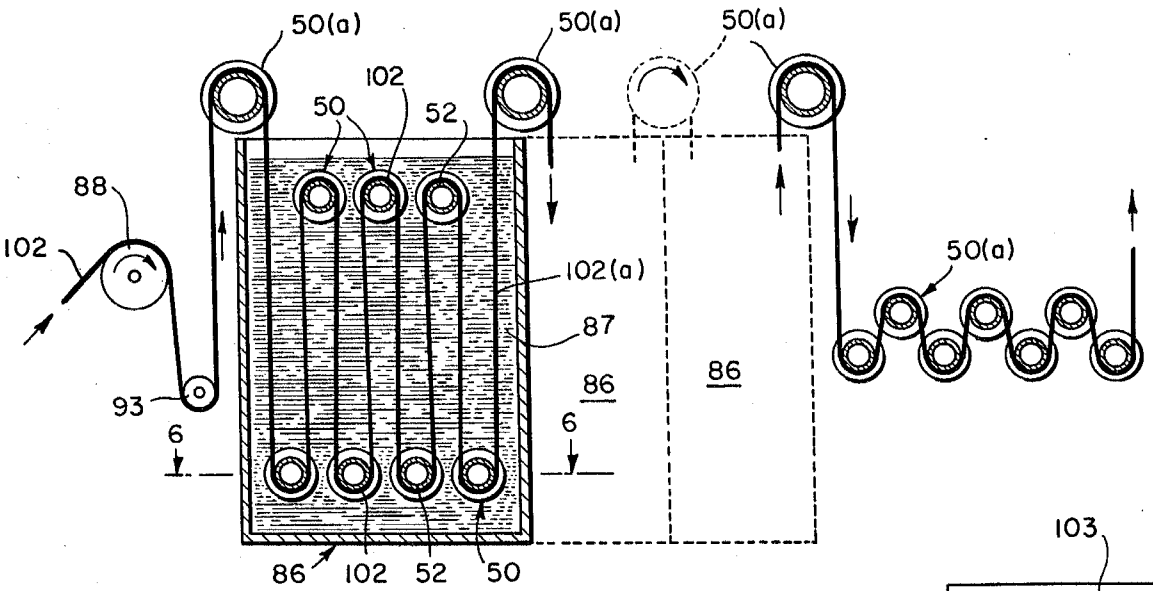
FIG. 5 is a schematic view of a section of a web processing apparatus employing the invention.

Turning now to FIG. 5, there is shown a plurality of treating tanks 86, only one of which is shown in detail. Positioned in each tank 86, but only shown in tank 86 in detail, are a plurality of fluid bearings 50 of the type hereinbefore described in connection with FIG. 1. Some of bearings 50 are positioned at the top of each tank 86 just below the level of the liquid 87 therein, while others of bearings 50 are positioned in a row adjacent the bottom of each tank 86. Fluid bearings 50 in the tanks 86 will hereinafter be referred to as liquid bearings. A gas bearing 50(*a*) of the type shown in FIG. 1 is positioned outside each of tanks 86. A rotatable driven roller 88 driven by any suitable mechanism (not shown) is provided. Also provided is a web tension roller 93, suspended by the web destined to be treated. Following tanks 86 are a plurality of gas bearings 50(*a*) of the type shown in FIG. 1. Following these gas bearings 50(*a*) is a conventional take-up mechanism (not shown) for taking up the treated web.

A plurality of webs 102 (only one is shown for illustrative purposes) is led from a suitable magazine (not shown) over driven roller 88, over tension roller 93 and over the first gas bearing 50(*a*). Web 102 extends sinuously part of the way around each liquid and gas bearing with its major surfaces 102(*a*) lying across channels 72 thereof as shown in FIGS. 1 and 2, and finally is passed over the conventional take-up mechanism (not shown). On delivery from the take-up mechanism, the now-processed web 102 is wound up on a suitable reel (not shown).

Web 102 passes sequentially through tanks 86 where it is chemically treated, as by the following examplary sequence:, solvent treatment, acid etching, water rinsing, neutralizing, water rinsing, acid etching, sensitizing, activating, electroless deposition, water rinsing and electroplating. Referring to FIG. 1, during passage of web 102 through each of tanks 86, the treating liquid in the respective tank is passed into fluid inlets 73, 74 and 76 of each bearing 50 in tank 86. The liquid passes through chambers 62 and 63 through apertures 68 through outer surface 52 at a certain fixed pressure, resulting in fluid layer 81. Liquid passes through chamber 64 through apertures 68 through the outer surface 52 at a relatively higher pressure than the fluid passing through chambers 62 and 63 to form fluid spike 83. The resultant fluid layer and fluid spike independently support and separate from one another each web of the plurality. The fluid pressures required and the fluid pressure gradient obtained is determined by means of valves 77, 78, 79 or by means of the size, shape and pattern of apertures 68 or by means of the shape of inlets 73, 74 or 76. The resultant fluid layer maintains the plurality of webs out of contact with outer surface 52.

Figure 6:
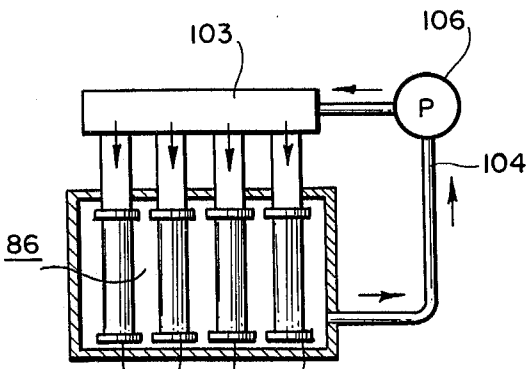
FIG. 6 is a schematic view of a section of the apparatus shown in FIG. 5 taken along line 6–6.

Illustratively, as seen in FIG. 6, a header 103 may be provided which is connected in fluid flow relationship with each liquid bearing 50 in each tank 86 and liquid from tank 86 is pumped through pipes 104 and a pump 106 into header 103, thereby establishing a continuous circulation system. One such system is provided for each tank 86. It will be noted that the liquid in question is continuously agitated, and that fresh recirculated liquid is continuously brought into contact with web 102 (FIG. 5). In addition, a pump and header system may be employed whereby air under pressure is passed into the inlets (73, 74, 76 of FIG. 1) of gas bearings 50(*a*) to maintain web 102 out of contact with outer surfaces 52 thereof. During passage of web 102 through the plurality of gas bearings following tanks 86, heated air from any suitable source and under pressure may be forced through air bearings and not only serves to support the web 102 above the outer surfaces 52 of these air bearings, but also serves the purpose of drying web 102, if necessary.

Tension roller 93 maintains a constant tension of web 102 and thus maintains web 102 in channel 72 (FIGS. 1 and 2). In the event that the loop around film tension roller 93 should become too short, automatic means (not shown) are provided to increase the speed of driven roller 88, thereby lengthening the loop, but the take-up mechanism is always at a constant speed.

What is claimed is:

1. A web treating apparatus which comprises:

a tank containing a treating liquid; and at least one liquid bearing capable of supporting a plurality of webs in spaced relationship in said liquid, said bearing comprising:

(a) a housing for containing said treating liquid within its interior, said housing having an outer surface for cooperating with a surface of each web to be supported;

(b) a guide means provided on said outer surface, defining with said outer surface a support channel, for maintaining each web to be supported within the boundaries of said defined support channel; and (c) means for passing said treating liquid from said interior of said housing through said outer surface within said channel to the exterior, to form a treating liquid layer thereover having at least one liquid spike therein in a central portion of said channel, said liquid layer supporting each web to be supported and said liquid spike restricting each supported web to a specified area over said channel and in spaced relationship from adjacent supported webs in said channel when more than one such web is supported.

2. The apparatus as defined in claim 1 wherein said housing comprises a first, a second and a third chamber for containing said liquid, said third chamber being adjacent to and separating said first and second chambers.

3. The apparatus as defined in claim 2 wherein said means for passing in (c) comprises:

a liquid outlet means communicating each chamber through said outer surface with the exterior of said housing; and a liquid inlet means for introducing said treating liquid into each of the chambers to pass said liquid through said outlet means through said outer surface within said channel, said liquid spike being effected by said outlet means or said inlet means.

4. The apparatus as defined in claim 2 wherein:

said supported web is restricted to an area over said channel corresponding to the adjacent cross-sectional area of said first chamber.

5. The apparatus as defined in claim 2 wherein said liquid spike is essentially within an area of said liquid layer corresponding to the adjacent cross-sectional area of said third chamber.

6. The apparatus as defined in claim 5 which further comprises:

a plurality of tanks, each containing a different treating liquid.

* * * * *